US008129891B2

(12) United States Patent
Nunome

(10) Patent No.: US 8,129,891 B2
(45) Date of Patent: Mar. 6, 2012

(54) SPARK PLUG

(75) Inventor: Kenji Nunome, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/989,586

(22) PCT Filed: Apr. 23, 2009

(86) PCT No.: PCT/JP2009/001867

§ 371 (c)(1),
(2), (4) Date: Oct. 25, 2010

(87) PCT Pub. No.: WO2009/130909

PCT Pub. Date: Oct. 29, 2009

(65) Prior Publication Data

US 2011/0043093 A1 Feb. 24, 2011

(30) Foreign Application Priority Data

Apr. 24, 2008 (JP) ..... 2008-113422

(51) Int. Cl.
*H01T 13/20* (2006.01)

(52) U.S. Cl. ..... 313/141; 313/144

(58) Field of Classification Search ..... 313/135, 313/141, 144

See application file for complete search history.

(56) References Cited

U.S. PATENT DOCUMENTS

| | | | |
|---|---|---|---|
| 6,304,022 | B1 | 10/2001 | Matsutani |
| 2002/0130602 | A1 | 9/2002 | Kanao et al. |
| 2004/0239223 | A1 | 12/2004 | Watanabe |
| 2005/0200255 | A1 | 9/2005 | Yoshimoto et al. |

FOREIGN PATENT DOCUMENTS

| | | | |
|---|---|---|---|
| JP | 8-298178 | A | 11/1996 |
| JP | 11-204233 | A | 7/1999 |
| JP | 2003-197347 | A | 7/2003 |
| JP | 2004-134209 | A | 4/2004 |
| JP | 2004-355957 | A | 12/2004 |
| JP | 2005-203110 | A | 7/2005 |
| JP | 2005-251606 | A | 9/2005 |

*Primary Examiner* — Vip Patel
(74) *Attorney, Agent, or Firm* — Sughrue Mion, PLLC

(57) ABSTRACT

A spark plug (100) including a noble metal tip (80) disposed on a distal end portion (31) of a ground electrode (30). The noble metal tip (80) is joined to the top surface of an intermediate member (81), which is a member separate from the ground electrode (30). The bottom surface of the intermediate member (81) is joined to the ground electrode (30), whereby the noble metal tip (80) is fixed to the ground electrode (30). The intermediate member (81) is formed such that its average hardness is higher than the average hardness of a portion of the ground electrode (30), excluding an intermediate portion (33) to be bent.

13 Claims, 7 Drawing Sheets

FIG. 6

| No. | Material | | Average hardness (Hv) | | | Outward bending (number of times) | Crossing angle θ (°) | Judgment |
|---|---|---|---|---|---|---|---|---|
| | Ground electrode | Intermediate member | Ground electrode | Intermediate member | Weld portion | | | |
| 1 | A | A | 161 | 164 | 210 | 7 | 5 | NG |
| 2 | A | A | 172 | 180 | 241 | 6 | 3 | OK |
| 3 | A | A | 172 | 190 | 256 | 6 | 2 | OK |
| 4 | A | A | 180 | 182 | 249 | 3 | 3 | NG |
| 5 | A | A | 174 | 205 | 301 | 6 | 1 | OK |
| 6 | B | B | 163 | 162 | 215 | 6 | 5 | NG |
| 7 | B | B | 173 | 174 | 230 | 5 | 4 | NG |
| 8 | B | B | 173 | 189 | 244 | 5 | 3 | OK |
| 9 | B | B | 184 | 186 | 250 | 3 | 3 | NG |
| 10 | B | B | 172 | 198 | 261 | 5 | 2 | OK |
| 11 | A | B | 171 | 179 | 247 | 6 | 4 | NG |
| 12 | A | B | 181 | 173 | 243 | 3 | 4 | NG |
| 13 | B | B | 171 | 185 | 242 | 6 | 3 | OK |
| 14 | A | B | 179 | 184 | 240 | 4 | 3 | OK |
| 15 | A | B | 172 | 207 | 306 | 6 | 1 | OK |
| 16 | A | B | 182 | 181 | 259 | 3 | 3 | NG |

SPARK PLUG

TECHNICAL FIELD

The present invention relates to a spark plug in which a spark gap is formed between a front end portion of a center electrode and a noble metal tip disposed on a ground electrode.

BACKGROUND ART

Spark plugs have been required not only to have an extended service life so as to achieve freedom from maintenance but also to realize enhanced ignition performance and combustion efficiency through reduction in size of electrodes. In order to meet such a requirement, there has been widely used a spark plug in which a noble metal tip formed of platinum, iridium, or the like is joined to a spark discharge portion of a center electrode. Further, in order to further enhance ignition performance, in a proposed technique, a noble metal tip is disposed not only on the center electrode but also on a ground electrode (the external electrode) (see, for example, Japanese Patent Application Laid-Open (kokai) No. 2004-134209).

As proposed in the above-mentioned patent document, the noble metal tip is fixed to the ground electrode through a process in which the noble metal tip is fixed to a member (an intermediate member) different from the ground electrode by means of laser welding, and the intermediate member carrying the noble metal tip joined thereto is joined to the ground electrode by means of resistance welding.

SUMMARY OF THE INVENTION

Problems to be Solved by the Invention

In recent years, engines themselves are designed to have enhanced performance, increased output, etc. Therefore, further improvement has been demanded for spark plugs of a type in which a noble metal tip is disposed on the ground electrode. More specifically, from the viewpoint of enhancement of ignition performance and durability, demand has arisen for suppression of misalignment between the center axis of a ground-electrode-side noble metal tip and that of a center-electrode-side noble metal tip. In an example technique devised for suppression of such misalignment, a ground electrode which carries a ground-electrode-side noble metal tip fixed thereto via an intermediate member is bent such that the ground-electrode-side noble metal tip faces a center-electrode-side noble metal tip, and the ground electrode is then moved via the intermediate member, which is grasped, to thereby correct the misalignment between the ground-electrode-side noble metal tip and the center-electrode-side noble metal tip.

However, if such misalignment is corrected while the intermediate member is grasped without consideration of mechanical properties of the intermediate member and the ground electrode, there may arise a problem in that the intermediate member deforms, and the degree of misalignment increases.

In view of the above-described problems, an object of the present invention is to provide a spark plug in which misalignment between the center axis of a noble metal tip disposed on a ground electrode and that of a center electrode can be properly corrected, even when correction of the misalignment is performed after the ground electrode is bent, to thereby improve ignition performance and durability. The present invention is based on an idea of considering the mechanical properties of the intermediate member and the ground electrode, which conventionally have not been taken into consideration.

Means for Solving the Problems

In order to achieve the above-described object, a spark plug according to one mode of the present invention is configured as follows. That is, the spark plug according to the mode comprises a center electrode; an insulator which has an axial hole extending along an axial direction and holds the center electrode in the axial hole; a metallic shell which circumferentially surrounds and holds the insulator; and a ground electrode whose base end portion is joined to the metallic shell and which is bent at an intermediate portion thereof between the base end portion and a distal end portion of the ground electrode such that the distal end portion faces a front end portion of the center electrode, wherein a noble metal tip is disposed on the distal end portion of the ground electrode at a position which faces the front end portion of the center electrode, and a spark gap is formed between the front end portion of the center electrode and the noble metal tip. In the spark plug, the noble metal tip is joined to a top surface of an intermediate member, which is a member separate from the ground electrode, to thereby be united with the intermediate member, and a bottom surface of the intermediate member is joined to the ground electrode, whereby the noble metal tip is fixed to the ground electrode; and the intermediate member has an average hardness higher than an average hardness of a portion of the ground electrode, excluding the intermediate portion.

In the spark plug having the above-described structure, the average hardness of the intermediate member is higher than the average hardness of a portion of the ground electrode, excluding the intermediate portion. By virtue of this, even when the misalignment between the center axis of the center electrode and that of the noble metal tip disposed on the ground electrode is corrected after the bending of the ground electrode, the misalignment can be corrected properly. Therefore, local erosion of the noble metal tip, which would otherwise occur due to the misalignment, can be prevented, whereby ignition performance and durability can be enhanced.

The above-described spark plug may be as follows. For example, the average hardness of the ground electrode in Vickers hardness may be less than 180 Hv. In this case, bending of the ground electrode can be performed without any trouble, and correction of the misalignment between the center axis of the noble metal tip and that of the center electrode can be performed more properly. Further, the average hardness of the intermediate member in Vickers hardness may be 180 Hv or greater. In this case, the correction of the misalignment between the center axis of the noble metal tip and that of the center electrode can be performed more properly.

In the spark plug having the above-described structure, the intermediate member may have a larger-diameter portion on the side toward the ground electrode and a smaller-diameter portion on the side toward the noble metal tip, wherein at least the smaller-diameter portion has a fibrous metallographic structure extending approximately in parallel to the center axis of the noble metal tip. This configuration can increase the resistance against stress which acts on the intermediate member at the time of correction of the misalignment of the noble metal tip. Therefore, the misalignment of the noble metal tip can be corrected more properly.

In the spark plug having the above-described structure, the intermediate member may be formed such that at least a half of the intermediate member located on the side toward the noble metal tip may have a fibrous metallographic structure extending approximately in parallel to the center axis of the noble metal tip. This configuration also can increase the resistance against stress which acts on the intermediate member at the time of correction of the misalignment of the noble metal tip. Therefore, the misalignment of the noble metal tip can be corrected more properly.

In the spark plug having the above-described structure, a weld portion may be formed between the intermediate member and the noble metal tip, the weld portion being formed as a result of fusion of the intermediate member and the noble metal tip.

In the spark plug having the above-described structure, a distance between a surface of the ground electrode to which the intermediate member is joined and an end of a surface of the weld portion located on the side toward the noble metal tip may be set to 0.3 mm or greater. Since this configuration facilitates grasping of the intermediate member, the misalignment of the noble metal tip can be corrected properly.

In the spark plug having the above-described structure, a distance between the end surface of the noble metal tip and an end of a surface of the weld portion located on the side toward the noble metal tip may be set to 0.1 mm or greater. This configuration can suppress erosion of the end portion of the noble metal tip.

In the spark plug having the above-described structure, the average hardness of the weld portion in Vickers hardness may be 180 Hv or greater. This configuration enables the misalignment of the noble metal tip to be corrected properly even when the weld portion is grasped.

In the spark plug having the above-described structure, the intermediate member and the ground electrode may be formed of alloy materials having the same composition ratio. This increases the joint strength between the intermediate member and the ground electrode.

In the spark plug having the above-described structure, the noble metal tip may contain platinum (Pt) as a main component, and additionally contain at least one type of metal selected from iridium (Ir), rhodium (Rh), nickel (Ni), tungsten (W), palladium (Pd), ruthenium (Ru), and rhenium (Re). When such a noble metal tip is employed, erosion of the noble metal tip itself can be suppressed because of the compositional nature thereof.

In the spark plug having the above-described structure, a center-electrode-side noble metal tip may be joined to the front end portion of the center electrode such that the center-electrode-side noble metal tip faces the noble metal tip. In this case, since the spark gap is formed between the noble metal tips disposed to face each other, ignition performance and durability can be enhanced.

In the spark plug having the above-described structure, the center-electrode-side noble metal tip may contain iridium (Ir) as a main component, and additionally contain at least one type of metal selected from platinum (Pt), rhodium (Rh), nickel (Ni), tungsten (W), palladium (Pd), ruthenium (Ru), rhenium (Re), aluminum (Al), aluminum oxide ($Al_2O_3$), yttrium (Y), and yttrium oxide ($Y_2O_3$). When such a center-electrode-side noble metal tip is employed, erosion of the center-electrode-side noble metal tip itself can be suppressed because of the compositional nature thereof.

BRIEF DESCRIPTION OF THE DRAWINGS

FIG. 6 is an explanatory table showing a relation in average hardness between a ground electrode 30 and an intermediate member 81 used to attach the electrode tip 80 to a ground electrode 30, the materials of the intermediate member 81 and the electrode tip 80 being changed so as to perform an evaluation test, and also showing the results of the evaluation test.

MODE FOR CARRYING OUT THE INVENTION

Figure 1:
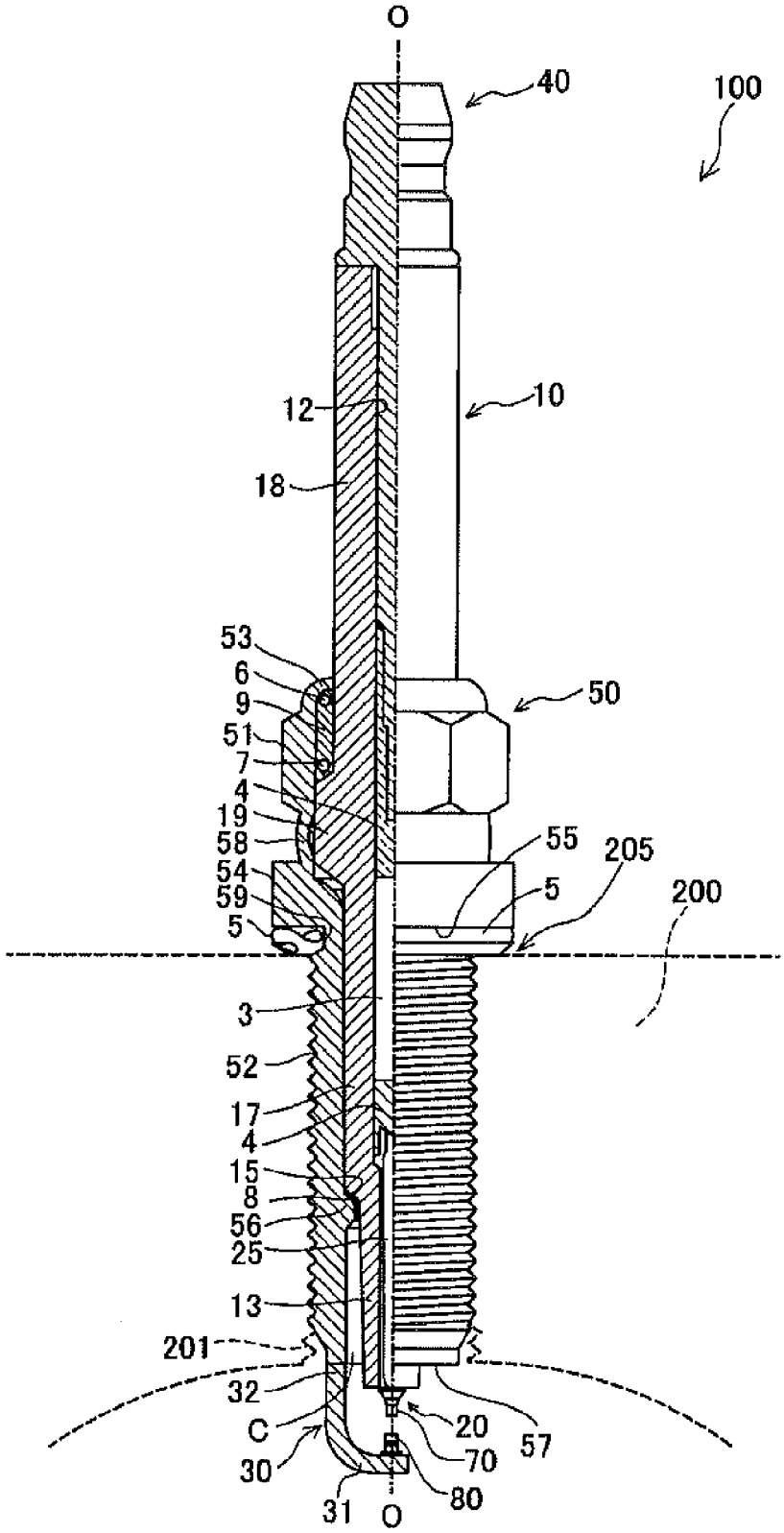
FIG. 1 is a partially sectioned view of a spark plug 100 according to an embodiment of the present invention.
Figure 2:
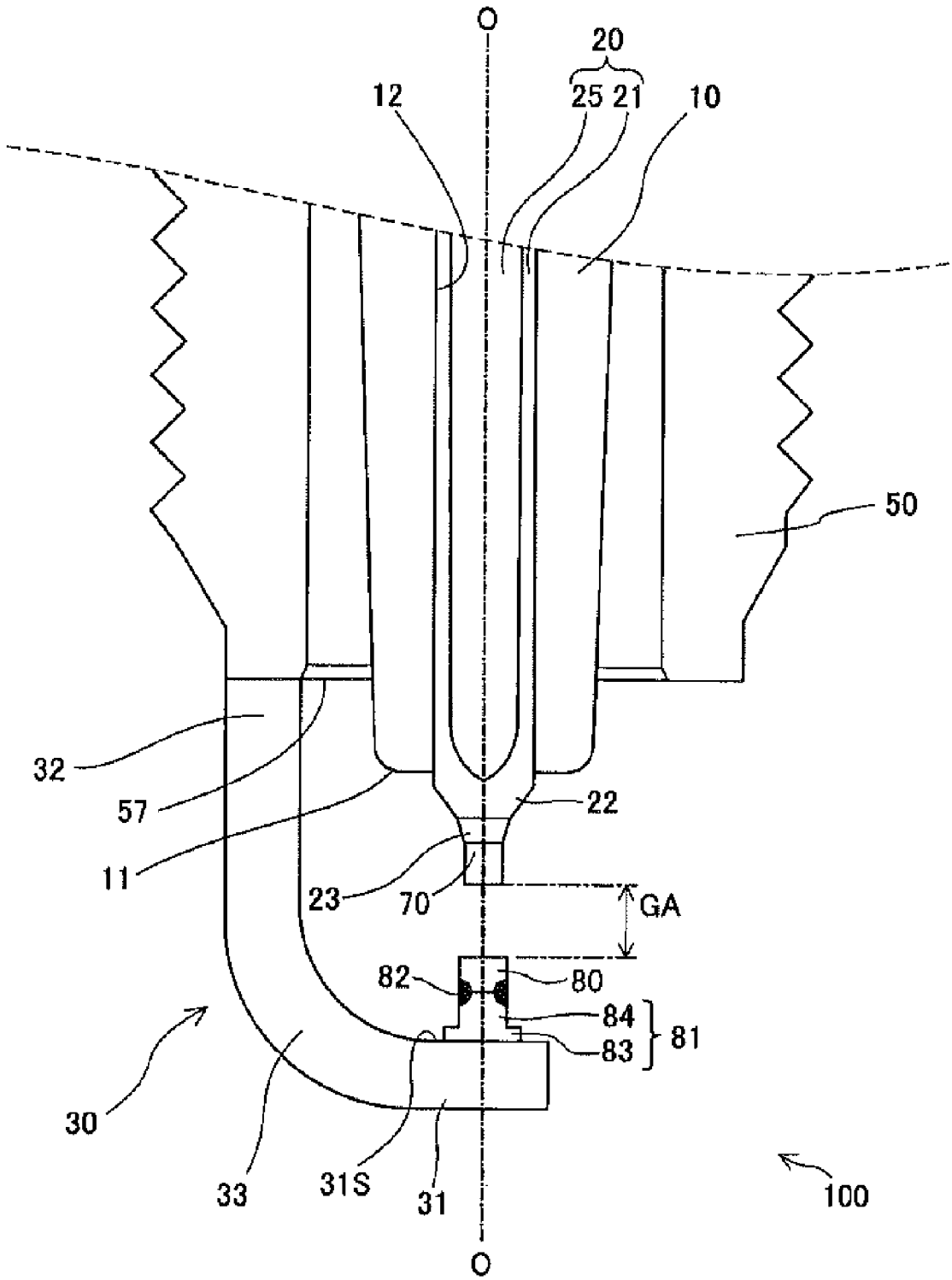
FIG. 2 is an enlarged view showing a front end of a center electrode 20 of the spark plug 100 and its vicinity on an enlarged scale.

An embodiment of the present invention will now be described by way of example. FIG. 1 is a partially sectioned view of a spark plug 100 according to an embodiment of the present invention. FIG. 2 is an enlarged view showing a front end of a center electrode 20 of the spark plug 100 and its vicinity on an enlarged scale. Notably, in the following description, the direction of an axis O of the spark plug 100 shown in FIG. 1 is referred to as the vertical direction, and the lower side of the spark plug 100 in the drawings is referred to as the front side of the spark plug 100, and the upper side as the rear side of the spark plug 100.

As shown in FIG. 1, the spark plug 100 includes an insulator (insulating member) 10; a metallic shell 50 which holds the insulator 10; the center electrode 20 held in the insulator 10 along the direction of the axis O; a ground electrode 30; and a metal terminal 40 provided at a rear end portion of the insulator 10.

As is well known, the insulator 10 is formed through firing of alumina or the like and has a tubular shape such that an axial hole 12 extends at the center along the direction of the axis O. The insulator 10 has a flange portion 19 formed substantially at the center with respect to the direction of the axis O and having the largest outside diameter, and a rear trunk portion 18 located rearward (on the upper side in FIG. 1) of the flange portion 19. The insulator 10 has a front trunk portion 17 located frontward (on the lower side in FIG. 1) of the flange portion 19 and having an outside diameter smaller than that of the rear trunk portion 18, and a leg portion 13 located frontward of the front trunk portion 17 and having an outside diameter smaller than that of the front trunk portion 17. The leg portion 13 is reduced in diameter toward its front end and is exposed to the interior of a combustion chamber when the spark plug 100 is mounted to an engine head 200 of an internal combustion engine. A step portion 15 is formed in a stepped manner between the leg portion 13 and the front trunk portion 17.

As shown in FIG. 2, the center electrode 20 is a rodlike electrode composed of an electrode base member 21 and a core member 25 embedded therein. The electrode base member 21 is formed of Ni or an alloy which predominantly contains Ni, such as INCONEL (trademark) 600 or 601. The core member 25 is formed of copper, which has excellent thermal conductivity as compared with the electrode base member 21, or an alloy which predominantly contains copper. In general, the center electrode 20 is manufactured through a process of placing the core member 25 into the electrode base member 21 formed into a bottomed tubular shape, and extruding the electrode base member 21 oriented such that its bottom is located on the front side, to thereby extend the electrode base member 21. The core member 25 is formed such that the core member 25 has an approximately constant diameter at a trunk portion thereof, but is tapered off at the front end thereof.

The center electrode 20; specifically, the electrode base member 21, has, at its front end portion, an electrode base member pedestal 22 tapered such that its diameter decreases toward the end thereof, a weld portion 23, and an electrode tip 70. A portion of the center electrode 20, which portion includes the electrode tip 70 and is located frontward of the electrode base member pedestal 22, projects from a front end portion 11 of the insulator 10. The electrode tip 70 is mainly formed of a noble metal having a high melting point so as to improve its resistance to spark-induced erosion. For example, the electrode tip 70 is formed of iridium (Ir) or an Ir alloy which contains Ir as a main component and to which at least one of platinum (Pt), rhodium (Rh), Ni (nickel), tungsten (W), palladium (Pd), ruthenium (Ru), rhenium (Re), aluminum (Al), aluminum oxide ($Al_2O_3$), yttrium (Y), and yttrium oxide ($Y_2O_3$) is added. An Ir-5Pt alloy (an iridium alloy containing platinum in an amount of 5% by mass); an Ir-11Ru-8Rh-1Ni alloy (an iridium alloy containing ruthenium in an amount of 11% by mass, rhodium in an amount of 8% by mass, and nickel in an amount of 1% by mass); etc. are widely used. In the present embodiment, the shortest distance (tip length), as measured in the axial direction, between the front end of the electrode tip 70 and the interface between the electrode tip 70 and the weld portion 23 is set to 0.5 to 1.2 mm.

The weld portion 23 is formed as a result of welding of the electrode tip 70 to the electrode base member pedestal 22; for example, laser welding in which a laser beam is applied to the interface between the electrode base member pedestal 22 and the electrode tip 70, and the electrode base member pedestal 22 and the electrode tip 70 are fused by means of heat generated upon application of the laser beam. That is, in a state where the electrode tip 70 is placed on the front end surface of the electrode base member pedestal 22, a laser beam is applied to the interface between the electrode base member pedestal 22 and the electrode tip 70, and the laser beam is moved in relation to the electrode base member pedestal 22 and the electrode tip 70 such that the irradiation point of the laser beam moves along the entire circumference of the interface. In the laser welding, as a result of application of a laser beam, the two materials (the constituent material of the electrode base member pedestal 22 and the noble metal of the electrode tip 70) are fused and mixed together. Therefore, the electrode tip 70 and the electrode base member pedestal 22 are strongly joined together, and the weld portion 23, which joins the electrode base member pedestal 22 and the electrode tip 70, is formed. As a result of fusion of the above-mentioned two materials, the weld portion 23 is formed in the form of an alloy of the two materials.

The center electrode 20 extends in the axial hole 12 toward the rear end thereof, and is electrically connected to the metal terminal 40 located rearward (on the upper side in FIG. 1) via a seal member 4 and a ceramic resistor 3 (see FIG. 1). A high-voltage cable (not shown) is connected to the metal terminal 40 via a plug cap (not shown) for application of high voltage.

The ground electrode 30 is formed of a metal which is high in corrosion resistance, and, for example, a nickel alloy, such as INCONEL (trademark) 600 or 601, is used. The ground electrode 30 generally has a rectangular transverse cross section in a direction perpendicular to the longitudinal direction thereof. A base end portion 32 of the ground electrode 30 is joined to a front end surface 57 of the metallic shell 50 by means of welding, and an intermediate portion 33 of the ground electrode 30 located between a distal end portion 31 and the base end portion 32 thereof is bent such that one side surface of the distal end portion 31 faces the electrode tip 70 of the center electrode 20 on the axis O. An electrode tip 80 is disposed on the distal end portion 31 of the ground electrode 30 at a position which faces the electrode tip 70 joined to the center electrode 20.

Like the electrode tip 70 provided on the center electrode 20, the electrode tip 80 is a noble metal tip which contains a noble metal as a main component. In the present embodiment, the electrode tip 80 is formed of a Pt alloy which contains platinum (Pt) as a main component and to which at least one of iridium (Ir), rhodium (Rh), nickel (Ni), tungsten (W), palladium (Pd), ruthenium (Ru), and rhenium (Re) is added. A Pt-20Rh alloy (a platinum alloy containing rhodium in an amount of 20% by mass), a Pt-20Ir-5Rh alloy (a platinum alloy containing iridium in an amount of 20% by mass and rhodium in an amount of 5% by mass), etc. are widely used.

The electrode tip 80 is previously joined, through laser welding or the like, to a top surface of an intermediate member 81, which is a member separate from the ground electrode 30. That is, the electrode tip 80 and the intermediate member 81 are united together via a weld portion 82 produced as a result of the welding. The intermediate member 81 is formed of the same nickel alloy (INCONEL 600 or 601) as the ground electrode 30. The intermediate member 81 has a columnar shape, and is formed such that a portion on the side toward the ground electrode 30 has a larger diameter, a portion on the side toward the electrode tip 80 has a smaller diameter, and a stepped portion is formed between the two portions. In the following description, the portion of the intermediate member 81 having a larger diameter will be referred to as a lower end flange portion 83, and the portion of the intermediate member 81 having a smaller diameter will be referred to as a smaller-diameter portion 84. For example, the intermediate member 81 can be manufactured as follows. A rod-shaped metal material having a diameter corresponding to that of the lower end flange portion 83 is prepared, and header working, which is one type of plastic working, is performed on the metal material, whereby the smaller-diameter portion 84 is formed. Alternatively, a rod-shaped metal material having a diameter greater than that of the lower end flange portion 83 is prepared, and both the lower end flange portion 83 and the smaller-diameter portion 84 are formed through header working.

The placement of the electrode tip 80 on the ground electrode 30 (specifically, the distal end portion 31) is performed as follows. The bottom surface of the lower end flange portion 83 of the intermediate member 81 carrying the electrode tip 80 joined thereto is pressed against a tip attachment surface 31S, which is one side surface of the distal end portion 31 of the ground electrode 30, and the lower end flange portion 83 is joined to the distal end portion 31 of the ground electrode 30 by means of resistance welding or the like.

As described above, the ground electrode 30 is bent at its intermediate portion 33 such that the end surface of the electrode tip 80 faces the end surface of the electrode tip 70 of the center electrode 20. Thus, a spark gap GA is formed between the electrode tip 70 and the electrode tip 80. In the spark plug 100 of the present embodiment, the spark gap GA is set to 0.3 to 1.5 mm. Further, as will be described later, the misalignment of the axis O' of the electrode tip 80 in relation to the axis O of the electrode tip 70; i.e., an error in parallelism between the end surface of the electrode tip 70 and that of the electrode tip 80, or an error in parallelism between the end surface of the electrode tip 80 and the tip attachment surface 31S of the distal end portion 31 of the ground electrode 30 to which the intermediate member 81 is joined, is set to be less than 4°. In the present embodiment, the tip length (as measured from the corresponding side surface of the distal end portion 31 of the ground electrode 30) of the electrode tip 80, which forms the spark gap GA as described above, is set to 0.5 to 1.2 mm, which is the same as the range of the tip length of the electrode tip 70.

The metallic shell 50 is a cylindrical tubular metallic member adapted to fix the spark plug 100 to the engine head 200 of the internal combustion engine. The metallic shell 50 holds the insulator 10 therein in such a manner as to surround a region of the insulator 10 extending from a portion of the rear trunk portion 18 to the leg portion 13. The metallic shell 50 is formed from low-carbon steel and includes a tool engagement portion 51 with which an unillustrated spark plug wrench is engaged, and a mounting screw portion 52 having a thread which is threadingly engaged with a mounting screw hole 201 of the engine head 200 provided at an upper portion of the internal combustion engine. In the present embodiment, the outer diameter M (nominal diameter) of the mounting screw portion 52 is set to M10 to M12.

The metallic shell 50 has a flange-like seal portion 54 formed between the tool engagement portion 51 and the mounting screw portion 52. An annular gasket 5 formed by bending a plate member is fitted to a screw neck portion 59 located between the mounting screw portion 52 and the seal portion 54. When the spark plug 100 is mounted to the engine head 200, the gasket 5 is crushed between a seat 55 of the seal portion 54 and the periphery 205 around an opening of the mounting screw hole 201, and deforms. As a result of deformation of the gasket 5, a seal is provided between the spark plug 100 and the engine head 200, whereby leakage from inside the engine via the mounting screw hole 201 is prevented.

The metallic shell 50 has a thin-walled crimp portion 53 located rearward of the tool engagement portion 51, and a similarly thin-walled buckle portion 58 located between the seal portion 54 and the tool engagement portion 51. Annular ring members 6 and 7 intervene between the inner circumferential surface of a portion of the metallic shell 50 extending between the tool engagement portion 51 and the crimp portion 53 and the outer circumferential surface of the rear trunk portion 18 of the insulator 10, and a space between the ring members 6 and 7 is filled with powder of talc 9. When the crimp portion 53 is crimped in such a manner as to be bent inward, the insulator 10 is pressed frontward in the metallic shell 50 via the ring members 6 and 7 and the talc 9. Accordingly, the step portion 15 of the insulator 10 is supported via an annular sheet packing 8 by a step portion 56 formed on the inner circumference of the metallic shell 50 at a position corresponding to the mounting screw portion 52, whereby the metallic shell 50 and the insulator 10 are united together. At this time, the sheet packing 8 maintains gas-tightness of the junction between the metallic shell 50 and the insulator 10, thereby preventing outflow of combustion gas. The buckle portion 58 is configured to be deformed outwardly as a result of application of compressive force in a crimping process, thereby increasing the stroke of compression of the talc 9 along the direction of the axis O and thus enhancing gas-tightness of the interior of the metallic shell 50. Notably, a clearance C of a predetermined dimension is provided between the insulator 10 and a portion of the metallic shell 50 located frontward of the step portion 56.

Figure 3:
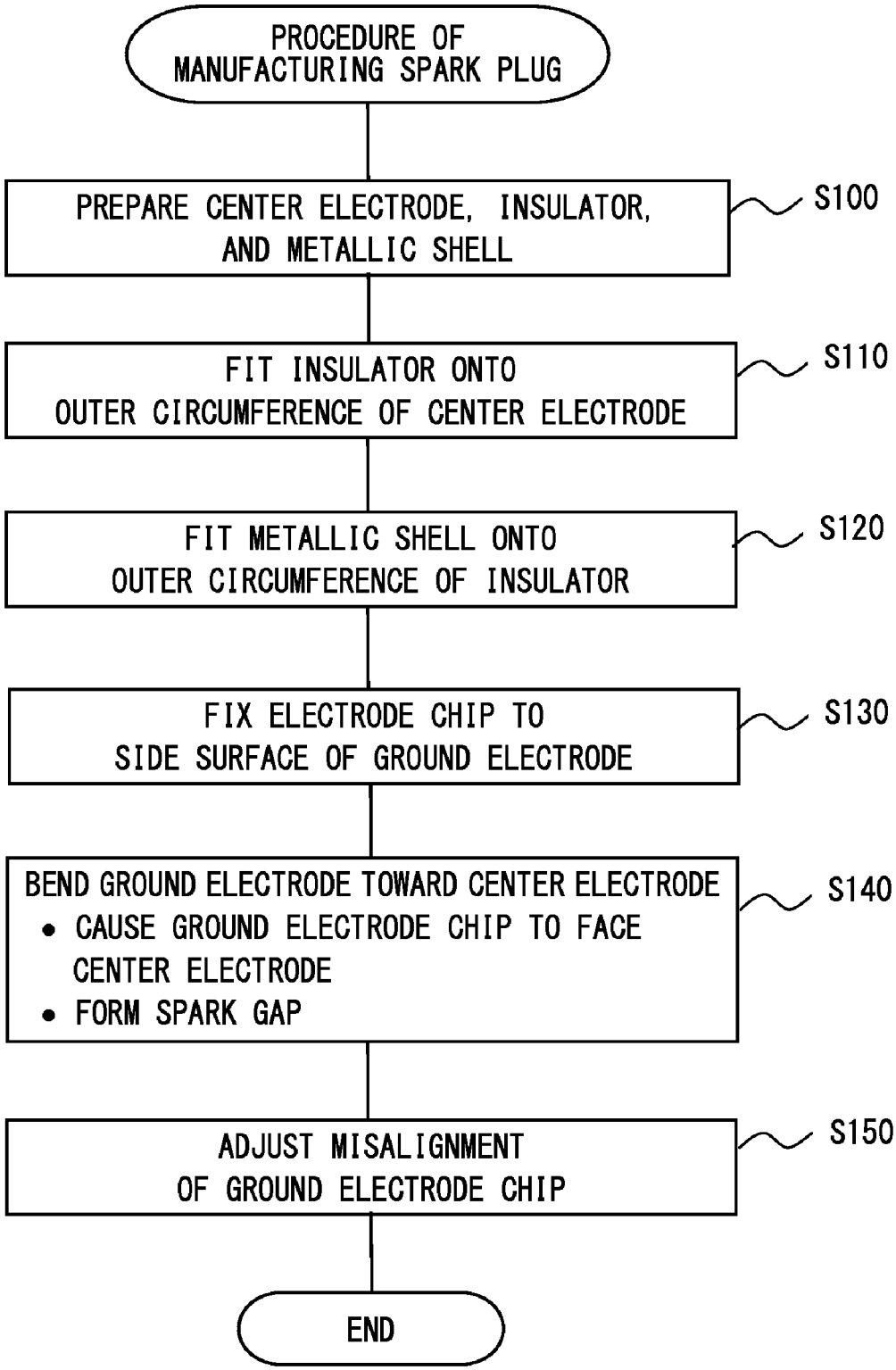
FIG. 3 is a flowchart showing a procedure of manufacturing a spark plug.
Figure 4:
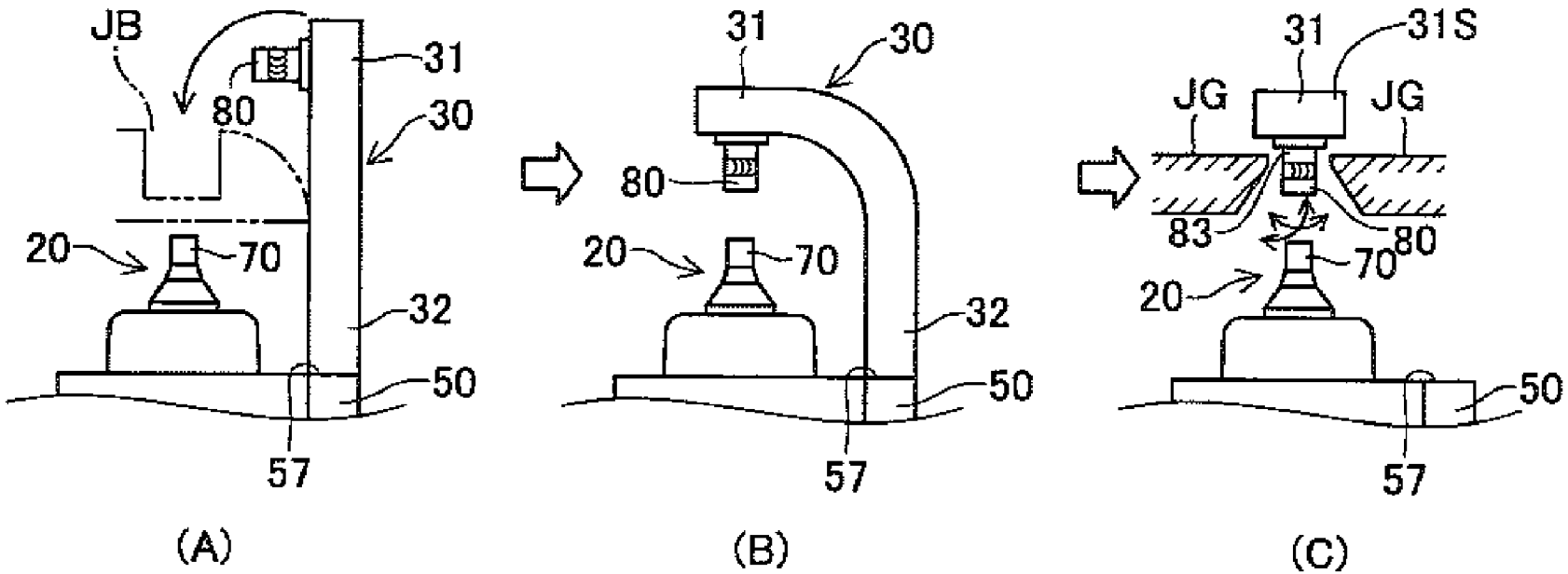
FIG. 4 is an explanatory view schematically showing operations in the manufacturing process of FIG. 3.
Figure 5:
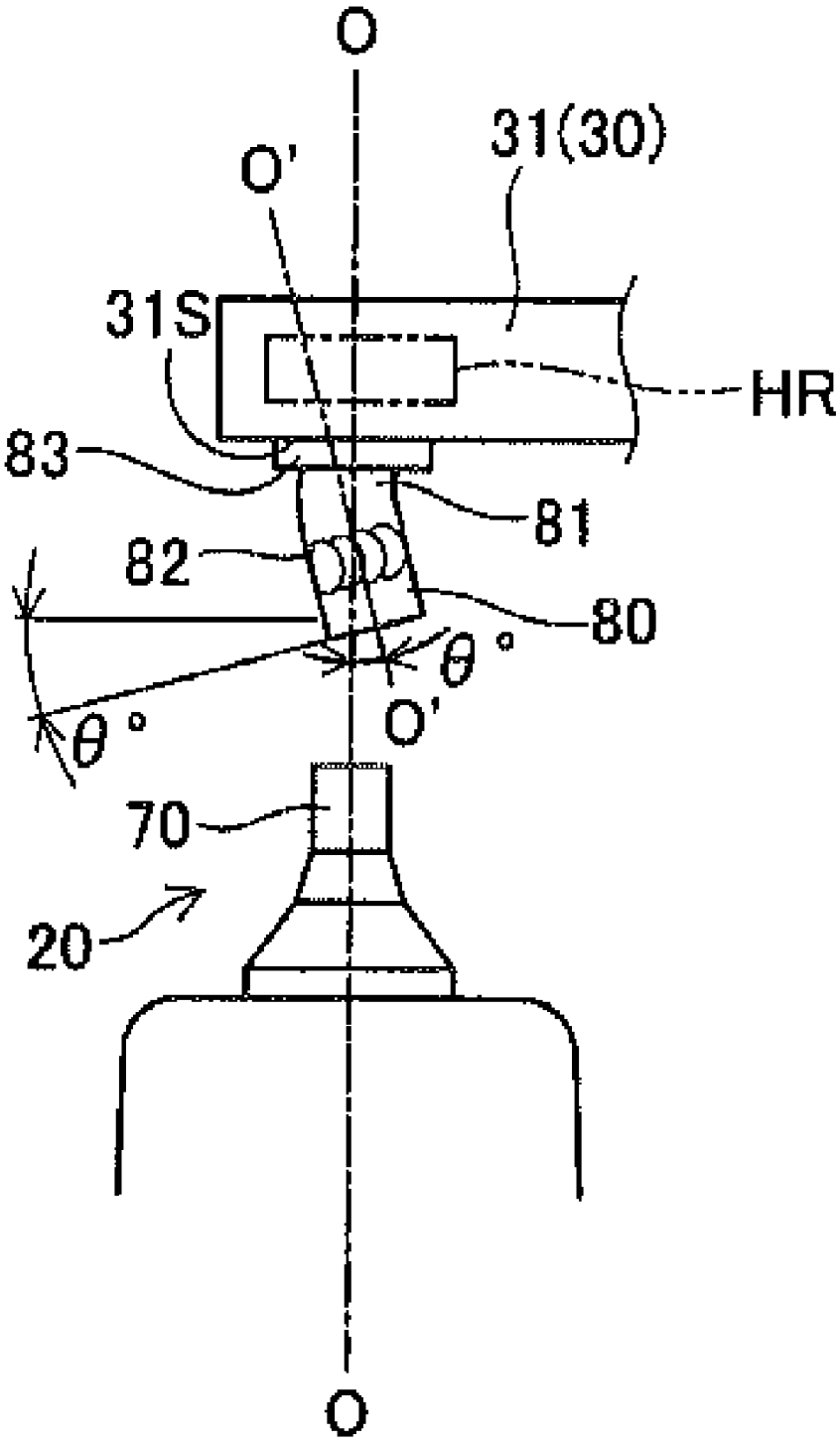
FIG. 5 is an explanatory view showing a state after adjustment of tip misalignment in the manufacturing process of FIG. 3.

Next, a process of manufacturing the above-described spark plug 100 will be described. FIG. 3 is a flowchart showing a procedure of manufacturing the spark plug. FIG. 4 is a set of explanatory views schematically showing operations in the manufacturing process. FIG. 5 is an explanatory view showing a state after adjustment of tip misalignment in the manufacturing process. As shown in FIG. 3, first, the center electrode 20, the insulator 10, and the metallic shell 50 are prepared (step S100). At that time, the center electrode 20 has the electrode tip 70 joined to the electrode base member pedestal 22 via the weld portion 23. Further, the metallic shell 50 has the ground electrode 30 whose base end portion 32 is fixed to the front end surface of the metallic shell 50 by means of welding. Subsequently, the insulator 10 is assembled such that a front end portion (specifically, the electrode tip 70, the weld portion 23, and the electrode base member pedestal 22) of the center electrode 20 is exposed, and the outer circumference of the center electrode 20 is covered by the insulator 10 (step S110). After that, the metallic shell 50 is assembled to the outer circumference of the insulator 10 such that a front end portion of the insulator 10 projects from the front end surface of the metallic shell 50 by an amount of, for example, 2 mm or more (step S120). The electrode tip 80, which is prepared separately and which is united with the intermediate member 81 via the weld portion 82, is fixed to the ground electrode 30 by means of joining the lower end flange portion 83 of the intermediate member 81 to the tip attachment surface 31S of the ground electrode 30 (step S130), and the ground electrode 30 is bent toward the center electrode 20 side (step S140).

When the ground electrode 30 is bent, as shown in FIG. 4(A), a bender jig JB for forming the intermediate portion 33 having a predetermined radius of curvature is pressed against the ground electrode 30 at a location at which the ground electrode 30 is bent, and the ground electrode 30 is bent such that the distal end portion 31 of the ground electrode 30 faces the electrode tip 70. As a result of this bending work, as shown in FIG. 4(B), the ground electrode 30 is bent with a predetermined radius of curvature such that the electrode tip 70 and the electrode tip 80 generally face each other. Thus, the spark gap GA having the above-described dimension is formed between the electrode tip 70 and the electrode tip 80.

In the present embodiment, subsequent to the formation of the spark gap GA performed by means of bending the ground electrode 30, adjustment of misalignment of the electrode tip 80 is performed (step S150). In the present embodiment, the adjustment of misalignment is performed as shown in FIG. 4(C). Specifically, the lower end flange portion 83 of the intermediate member 81 is grasped by means of a tip-grasping jig JG, and the misalignment of the electrode tip 80 is adjusted by use of the tip-grasping jig JG such that the error in parallelism between the end surface of the electrode tip 80 and that of the electrode tip 70, or the error in parallelism between the end surface of the electrode tip 80 and the tip attachment surface 31S of the distal end portion 31 of the ground electrode 30 to which the intermediate member 81 is joined, becomes less than 4°. After completion of the adjustment of misalignment, as shown in FIG. 5, the crossing angle θ of the axis O' of the electrode tip 80 in relation to the axis O of the electrode tip 70 becomes less than 4°, whereby the end surface of the electrode tip 80 and the end surface of the electrode tip 70 face each other in approximately parallel to each other with an error within an angular range of 4°.

Figure 7:
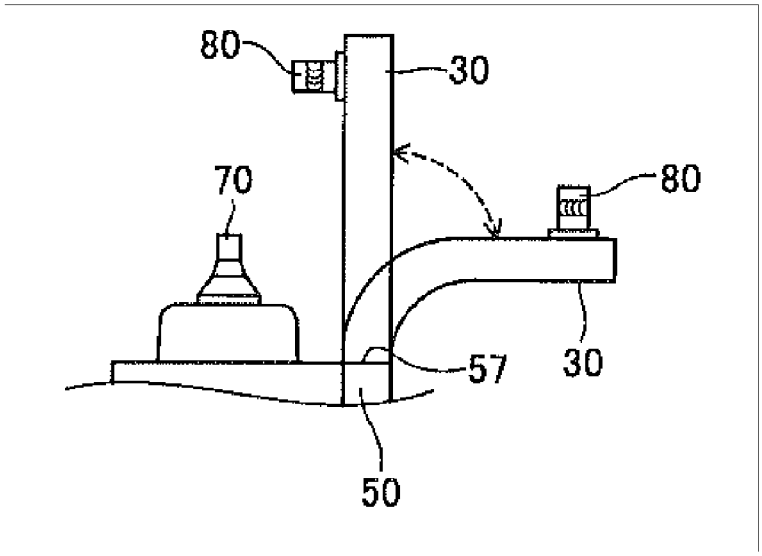
FIG. 7 is an explanatory view showing a method of determining the number of times of outward bending, which is an evaluation item in the table of FIG. 6.

Next, an evaluation test performed for the spark plug 100 of the present embodiment will be described. FIG. 6 is an explanatory table showing a relation in average hardness between the intermediate member 81 and the ground electrode 30, the materials of the intermediate member 81 and the ground electrode 30 being changed so as to perform an evaluation test, and also showing the results of the evaluation test. FIG. 7 is an explanatory view showing a method of determining the number of times of outward bending, which is an evaluation item in the table of FIG. 6.

For example, in the case of the spark plug of sample No. 1 in FIG. 6, both the intermediate member 81 and the ground electrode 30 are formed of INCONEL 600 indicated as a material A in the drawing, the average hardness of the ground electrode 30 is 161 Hv (Vickers hardness), and the average hardness of the intermediate member 81 (specifically, the intermediate member 81 (excluding the smaller-diameter portion 84) and the lower end flange portion 83) is 164 Hv. Further, the average hardness of the weld portion 82 is 210 Hv. In the present embodiment, the average hardness is measured in accordance with the procedure prescribed in the Japanese Industrial Standard (JIS Z 2224/test force: 4.903 N). For example, the average hardness of the ground electrode 30 is the average of values of hardness measured at 10 points contained in a measurement area HR (shown in FIG. 5) in the vicinity of a joint portion of the ground electrode 30 to which the intermediate member 81 is joined. Notably, the average hardness of the ground electrode 30 may be measured in any portion of the ground electrode 30, excluding the bent intermediate portion 33; for example, in a portion of the ground electrode 30 near the base end portion 32 thereof. The average hardness of the intermediate member 81 is the average of values of hardness measured at 3 points on the surface of the intermediate member 81, excluding the smaller-diameter portion 84; that is, the surface of the lower end flange portion 83 and the surface of the intermediate member 81 located between the weld portion 82 and the lower end flange portion 83. In this case, the average of values of hardness measured at 10 points may be used as the average hardness of the intermediate member 81. Notably, in the case where an area sufficient for measurement of hardness is not available, the average of hardnesses measured at 10 points may be obtained by use of a plurality of spark plugs manufactured under the same conditions. In such a case, in the bending test, the average of the numbers of times of bending performed for a plurality of spark plugs is used.

Further, a bending test was performed for the spark plug of sample No. 1 as shown in FIG. 7. In the bending test, the ground electrode 30 was repeatedly bent outward at the base end portion 32 such that the ground electrode 30 moved away from the center electrode 20. In the case of the spark plug of sample No. 1, the base end portion 32 fractured and separated from the metallic shell 50 after the seventh bending of the ground electrode 30. Further, the crossing angle θ (see FIG. 5) of the axis O' of the electrode tip 80 in relation to the axis O of the electrode tip 70 was measured after completion of the adjustment of misalignment in step S150 of FIG. 3. FIG. 6 shows that, in the case of the spark plug of sample No. 1, the measured crossing angle is 5°.

In the present embodiment, if the number of times of such outward bending performed for a certain spark plug is equal to or less than 3 times, the certain spark plug is judged to be no good (NG), because, when the ground electrode 30 shown in FIG. 4 is bent in accordance with a regular manufacturing procedure, the ground electrode 30 may break at the base end portion 32.

If the crossing angle θ of the axis of the electrode tip 80 of a certain spark plug is 4° or greater, the certain spark plug is judged to be no good (NG) for the following reason. The greater the crossing angle θ, the greater the inclination of the end surface of the electrode tip 80 in relation to the end surface of the electrode tip 70 of the center electrode 20. If the end surface of the electrode tip 80 is inclined, in the spark gap GA, discharge occurs locally at a portion of the inclined end surface of the electrode tip 80 closest to the electrode tip 70 of the center electrode 20. Therefore, a portion of the end surface of the electrode tip 80 closest to the electrode tip 70 of the center electrode 20 erodes easily. Since the greater the inclination of the tip end surface, the greater the extent to which the spark gap GA expands with erosion of the tip end surface, a drop in stability of discharge, and, thus, a drop in ignition performance may occur. Therefore, a spark plug in which the crossing angle θ of the axis of the electrode tip 80 was 4° or greater was judged to be no good (NG).

Of the spark plugs 100 of Nos. 1 to 16 shown in FIG. 6, the spark plugs 100 of Nos. 2, 3, 5, 8, 10, and 13 to 15 are judged to be good (OK) in terms of the above-mentioned two evaluation items; i.e., the number of times of outward bending and the crossing angle θ. Of these spark plugs 100, the spark plugs of Nos. 2, 3 and 5 are such that both the intermediate member 81 and the ground electrode 30 are formed of the material A (INCONEL 600); the spark plugs of Nos. 8, 10, and 13 are such that both the intermediate member 81 and the ground electrode 30 are formed of the material B (INCONEL 601); and the spark plugs of Nos. 14 and 15 are such that the intermediate member 81 is formed of the material A (INCONEL 600), and the ground electrode 30 is formed of the material B (INCONEL 601). In the case of the spark plugs 100 of these sample numbers, the results confirmed that the average hardness of the intermediate member 81 is higher than the average hardness of the ground electrode 30 in the measurement area HR shown in FIG. 5, which area is located in the vicinity of the joint portion of the ground electrode 30. In addition, the results confirmed that the average Vickers hardness of the ground electrode 30 is less than 180 Hv, and the average Vickers hardness of the intermediate member 81 is 180 Hv or greater, preferably, 200 Hv or greater. Further, the results confirmed that the average Vickers hardness of the weld portion 82 is 180 Hv or greater, and approximately 200 to 300 Hv.

That is, the requirements associated with the above-described evaluation items (the number of times of outward bending and the crossing angle θ) are satisfied if the spark plug 100 is manufactured as follows. When the ground electrode 30 to which the electrode tip 80 is joined via the intermediate member 81 is prepared, each of the ground electrode 30 and the intermediate member 81 is formed of the material A (INCONEL 600) or the material B (INCONEL 601); and the conditions under which the intermediate member 81 is joined to the ground electrode 30 and the conditions under which the ground electrode 30 is welded, at its base end portion 32, to the metallic shell 50 are prescribed such that, after completion of the spark plug 100, the average hardness of the ground electrode 30 and the average hardness of the intermediate member 81 have the above-described relation. Therefore, by means of performing the joining of the intermediate member 81 and the welding of the ground electrode 30 under the prescribed conditions, breakage of the ground electrode 30 can be avoided, and the adjustment of misalignment of the electrode tip 80 can be simplified, which is preferable.

In addition to prescribing the joint conditions, etc. as described above, the following measures may be taken. In general, as a result of the joining of the intermediate member 81 and the welding of the ground electrode 30, the hardnesses of the intermediate member 81 and the ground electrode 30 drop due to tempering. Therefore, in the case where each of the intermediate member 81 and the ground electrode 30 is formed of the material A (INCONEL 600) or the material B (INCONEL 601), in consideration of drop in hardness, it is effective to perform quenching to thereby increase their hardnesses in advance.

In the case of the spark plugs 100 of sample Nos. 2, 3, 5, 8, 10, and 13 to 15, since the crossing angle θ between the electrode tip 70 provided on the center electrode 20 and the electrode tip 80 which faces the electrode tip 70 and is provided on the ground electrode 30 is small (less than 4°), an increase in the spark gap GA due to tip erosion can be suppressed. Therefore, it is possible to enhance ignition performance and durability by means of suppressing drop in durability and ignition failure which are considered to occur because of erosion of the electrode tip 80. In addition, the strength of welding of the ground electrode 30 to the metallic shell 50 can be secured.

Of the spark plugs 100 of sample Nos. 1 to 16, the spark plugs 100 of sample Nos. 4, 9, 12, and 16 are judged to be no good (NG) for the evaluation item of the number of times of outward bending. In the case of these spark plugs, since the average hardness of the ground electrode 30 is 180 Hv or greater, the ground electrode 30 is excessively hard, and, thus, a large force is required to bend the ground electrode 30. Thus, the stress acting on the welded portion of the base end portion 32 becomes greater, and exceeds the welding strength. Therefore, the number of times of outward bending decreases. That is, the results confirmed that, in order to satisfy the requirement associated with the number of times of outward bending, which is performed to evaluate the ability of avoiding breakage of the welded portion of the ground electrode 30, the average hardness of the ground electrode 30 must be set to be less than 180 Hv.

Meanwhile, the spark plugs 100 of sample Nos. 1, 6, 7, and 11 are judged to be no good (NG) for the evaluation item of the crossing angle θ although they are judged to satisfy the requirement regarding the evaluation item of the number of times of outward bending. In the case of these spark plugs, although the average hardness of the ground electrode 30 is less than 180 Hv, the average hardness of the intermediate member 81 is less than 180 Hv. The low average hardness of the intermediate member 81 is expected to cause misalignment of the electrode tip 80 at the time of the adjustment of misalignment. The results confirmed that, in order to satisfy the predetermined requirement regarding the crossing angle θ while suppressing the misalignment of the electrode tip 80, the average hardness of the intermediate member 81 must be set to 180 Hv or greater.

Although the embodiment of the present invention has been described, the present invention is not limited to the above-described embodiment, and various configurations may be employed without departing from the scope of the invention.

Figure 8:
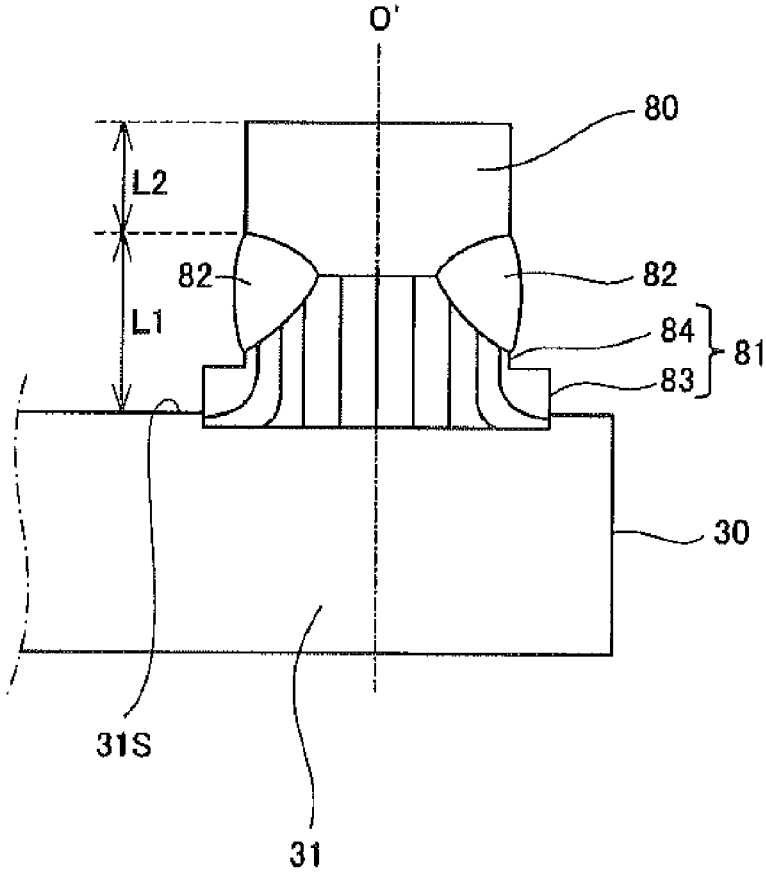
FIG. 8 is a cross sectional view of a distal end portion 31 of the ground electrode 30 and its vicinity.

For example, as shown in FIG. 8, a distance L1 between the tip attachment surface 31S of the ground electrode 30 and the upper end of the surface of the weld portion 82 may be set to 0.3 mm or greater. FIG. 8 is an enlarged cross sectional view of the distal end portion 31 of the ground electrode 30 and its vicinity. Since, as described above, the electrode tip 80 is formed of a noble metal such as platinum, although its hardness is high (about 300 Hv), the electrode tip 80 has a property of easily tipping from the grain boundary because of its crystalline structure. In contrast, the weld portion 82 in which a nickel alloy and a noble metal are mixed has a relatively high hardness of 180 Hv or greater (see FIG. 6); however, the property of easily tipping from the grain boundary is mild as compared with the noble metal. In view of this, the distance L1 between the tip attachment surface 31S of the ground electrode 30 and the upper end of the surface of the weld portion 82 is set to 0.3 mm or greater as described above. Through this setting, a contact area over which the tip-grasping jig JG is brought into contact with the intermediate member 81 and the weld portion 82 can be secured sufficiently. Therefore, it becomes possible to easily perform the adjustment of misalignment without contacting the electrode tip 80, which is likely to tip. Notably, in consideration of the fact that the tip length is set to 0.5 to 1.2 mm in the above-described embodiment, the upper limit of the distance L1 may be set to about 0.5 mm.

Further, a distance L2 between the end surface of the electrode tip 80 and the upper end of the surface of the weld portion 82 may be set to 0.1 mm or greater. The weld portion 82 is inferior to the electrode tip 80 in terms of resistance to oxidation and resistance to spark-induced erosion. Therefore, if the electrode tip 80 and the intermediate member 81 are joined together in such a manner that the weld portion 82 reaches the end surface of the electrode tip 80 at a certain portion thereof, that portion of the end surface may be selectively eroded. In contrast, in the case where the distance L2 between the end surface of the electrode tip 80 and the upper end of the surface of the weld portion 82 is set to 0.1 mm or greater as described above, such erosion of the end portion of the electrode tip 80 can be suppressed. Notably, in consideration of the fact that the tip length is set to 0.5 to 1.2 mm in the above-described embodiment, the upper limit of the distance L2 may be set to about 0.4 mm.

Further, of the intermediate member 81, which includes the smaller-diameter portion 84 and the lower end flange portion 83, at least the smaller-diameter portion 84 may have a fibrous metallographic structure extending in parallel to the axis O' of the electrode tip 80. The intermediate member 81 having such a fibrous structure can be produced by means of drawing a metal material from which the intermediate member 81 is formed. In the case where the intermediate member 81 is formed to have a fibrous metallographic structure extending along a direction parallel to the axis O' of the electrode tip 80, the resistance to stress acting on the intermediate member 81 at the time of correction of misalignment of the electrode tip 80 can be increased. Therefore, misalignment of the electrode tip 80 can be corrected more properly. Further, in the case where the intermediate member 81 is formed to have such a fibrous metallographic structure, even when the spark plug 100 receives vibration from an engine, it is possible to prevent deformation of the intermediate member 81 which would otherwise deform due to the received vibration. Such an effect becomes remarkable when the spark plug 100 is attached to an engine which is high in output or rotational speed. Notably, in the above-described embodiment, since the smaller-diameter portion 84 is formed through header working, a portion of the smaller-diameter portion 84 close to the lower end flange portion 83 may have a metallographic structure which does not extend in parallel with the axis O' of the electrode tip 80. However, even in such a case, the smaller-diameter portion 84 can be said to substantially have a fibrous metallographic structure extending in parallel to the axis O' of the electrode tip 80.

In the above-described embodiment, the intermediate member 81 is composed of the smaller-diameter portion 84 and the lower end flange portion 83. However, formation of the lower end flange portion 83 can be omitted. That is, the entire intermediate member 81 may be formed into a straight cylindrical shape. In this case, preferably, at least a half of the intermediate member 81 on the side where the weld portion

82 is present has the above-described fibrous metallographic structure. Needless to say, irrespective of whether or not the lower end flange portion 83 is present, the entirety of the intermediate member 81 may have a fibrous metallographic structure extending in parallel to the axis O' of the electrode tip 80.

The invention claimed is:

1. A spark plug comprising a center electrode; an insulator which has an axial hole extending along an axial direction and holds the center electrode in the axial hole; a metallic shell which circumferentially surrounds and holds the insulator; and a ground electrode whose base end portion is joined to the metallic shell and which is bent at an intermediate portion thereof between the base end portion and a distal end portion of the ground electrode such that the distal end portion faces a front end portion of the center electrode, wherein a noble metal tip is disposed on the distal end portion of the ground electrode at a position which faces the front end portion of the center electrode, and a spark gap is formed between the front end portion of the center electrode and the noble metal tip, the spark plug being characterized in that the noble metal tip is joined to a top surface of an intermediate member, which is a member separate from the ground electrode, to thereby be united with the intermediate member, and a bottom surface of the intermediate member is joined to the ground electrode, whereby the noble metal tip is fixed to the ground electrode; and the intermediate member has an average hardness higher than an average hardness of a portion of the ground electrode, excluding the intermediate portion.

2. A spark plug according to claim 1, wherein the average hardness of the ground electrode in Vickers hardness is less than 180 Hv.

3. A spark plug according to claim 1, wherein the average hardness of the intermediate member in Vickers hardness is 180 Hv or greater.

4. A spark plug according to claim 1, wherein the intermediate member has a larger-diameter portion on the side toward the ground electrode and a smaller-diameter portion on the side toward the noble metal tip, and at least the smaller-diameter portion has a fibrous metallographic structure extending approximately in parallel to the center axis of the noble metal tip.

5. A spark plug according to claim 1, wherein the intermediate member is formed such that at least a half of the intermediate member located on the side toward the noble metal tip has a fibrous metallographic structure extending approximately in parallel to the center axis of the noble metal tip.

6. A spark plug according to claim 1, wherein a weld portion is formed between the intermediate member and the noble metal tip, the weld portion being formed as a result of fusion of the intermediate member and the noble metal tip.

7. A spark plug according to claim 6, wherein a distance between a surface of the ground electrode to which the intermediate member is joined and an end of a surface of the weld portion located on the side toward the noble metal tip is 0.3 mm or greater.

8. A spark plug according to claim 6, wherein a distance between an end surface of the noble metal tip and an end of a surface of the weld portion located on the side toward the noble metal tip is 0.1 mm or greater.

9. A spark plug according to claim 6, wherein the average hardness of the weld portion in Vickers hardness is 180 Hv or greater.

10. A spark plug according to claim 1, wherein the intermediate member and the ground electrode are formed of alloy materials having the same composition ratio.

11. A spark plug according to claim 1, wherein the noble metal tip contains platinum (Pt) as a main component, and additionally contains at least one type of metal selected from iridium (Ir), rhodium (Rh), nickel (Ni), tungsten (W), palladium (Pd), ruthenium (Ru), and rhenium (Re).

12. A spark plug according to claim 1, wherein a center-electrode-side noble metal tip is joined to the front end portion of the center electrode such that the center-electrode-side noble metal tip faces the noble metal tip.

13. A spark plug according to claim 12, wherein the center-electrode-side noble metal tip contains iridium (Ir) as a main component, and additionally contains at least one type of metal selected from platinum (Pt), rhodium (Rh), nickel (Ni), tungsten (W), palladium (Pd), ruthenium (Ru), rhenium (Re), aluminum (Al), aluminum oxide ($Al_2O_3$), yttrium (Y), and yttrium oxide ($Y_2O_3$).

* * * * *